United States Patent [19]

Killian

[11] 4,300,740

[45] Nov. 17, 1981

[54] EASILY MOVABLE SHELF FOR STEP LADDER

[76] Inventor: Robert M. Killian, 33 W. Blithedale #5, Mill Valley, Calif. 94941

[21] Appl. No.: 148,794

[22] Filed: May 12, 1980

[51] Int. Cl.[3] ..... E06C 7/14

[52] U.S. Cl. ..... 248/238; 182/121; 182/129

[58] Field of Search ..... 182/120, 121, 122, 123, 182/53, 54, 55, 129; 248/238

[56] References Cited

U.S. PATENT DOCUMENTS

| | | | |
|---|---|---|---|
| 383,471 | 5/1888 | Lacy | 182/54 |
| 467,685 | 1/1892 | Hammon | 182/116 |
| 1,593,366 | 7/1926 | Singer | 248/210 |
| 2,066,108 | 12/1936 | Hedges | 182/120 |
| 2,444,096 | 6/1948 | Faust | 182/120 |
| 2,473,951 | 6/1949 | Hickey | 182/120 |
| 2,936,989 | 5/1960 | Siek | 248/238 |
| 4,029,280 | 6/1977 | Golz | 248/210 |

*Primary Examiner*—Reinaldo P. Machado
*Attorney, Agent, or Firm*—Melvin R. Stidham

[57] ABSTRACT

A shelf, having a pair of brackets which extend downward and then forward from its back edge to engage the back edge and underside of either a step, or the top ledge, of a ladder. A stop member, which may be in the form of a pin loosely slidable in a hole through the shelf is spaced so that when the shelf is engaged on a step and pulled forward to bring the brackets snug against the back edge, the pin drops down to be engagable with the front edge and to prevent the shelf from being inadvertently pushed backward from the step. The pin may be pushed up with one finger under it, and the shelf pushed back to disengage the bracket for removal.

4 Claims, 3 Drawing Figures

EASILY MOVABLE SHELF FOR STEP LADDER

BACKGROUND OF THE INVENTION

Painters usually have a step ladder at hand and, when painting at intermediate levels, prefer to avoid stooping by placing the basket on some raised platform. The shelf that is often carried on a step ladder is usually too high when the painter is standing at ground or floor level and in any event painting contractors often remove such shelves to eliminate any temptation the painter may have to use them as a platform to stand on. As an alternative then, painters often place their paint can on the steps of the ladder from which they may be easily dislodged. Others have devised platforms which may be mounted on the steps but such usually require threading or unthreading bolts, clamps or the like and, often, workman do not like to be bothered with such.

OBJECTS OF THE INVENTION

It is an object of this invention to provide a shelf for a selected step of a ladder which may be quickly and easily placed and removed as desired.

It is a further object of this invention to provide an easily placed removably shelf for a ladder on which to support a worker's tools, equipment and supplies.

It is a further object of this invention to provide a platform for a paint can or the like which may be placed without adjustment or clamping, but which is secured against inadvertent removal.

Other objects and advantages of this invention will become apparent from the description to follow, particularly when read in conjunction with the accompanying drawings.

SUMMARY OF THE INVENTION

In carrying out this invention, I provide a flat shelf support which has a pair of brackets along one edge to engage an edge and underside of a ladder step, on which it is supported, so that it can not be dislodged by the weight of the paint can. A pin which is spaced from that same edge a distance slightly greater than the width of a ladder step is free to slide loosely in a hole through the platform so that when the bracket is engaged and the shelf fully engaged, the pin drops down adjacent the opposite edge of the step to prevent the shelf from being dislodged by inadvertently knocking against it. A second pin spaced slightly further, functions in the same manner with respect to the top ledge of the step ladder. A lip around the around the sides and front edge of the shelf prevents the paint can or tools from sliding off. When not in use, the shelf may be suspended from the back legs cross brace by means of the brackets.

DESCRIPTION OF A PREFERRED EMBODIMENT

Figure 1:
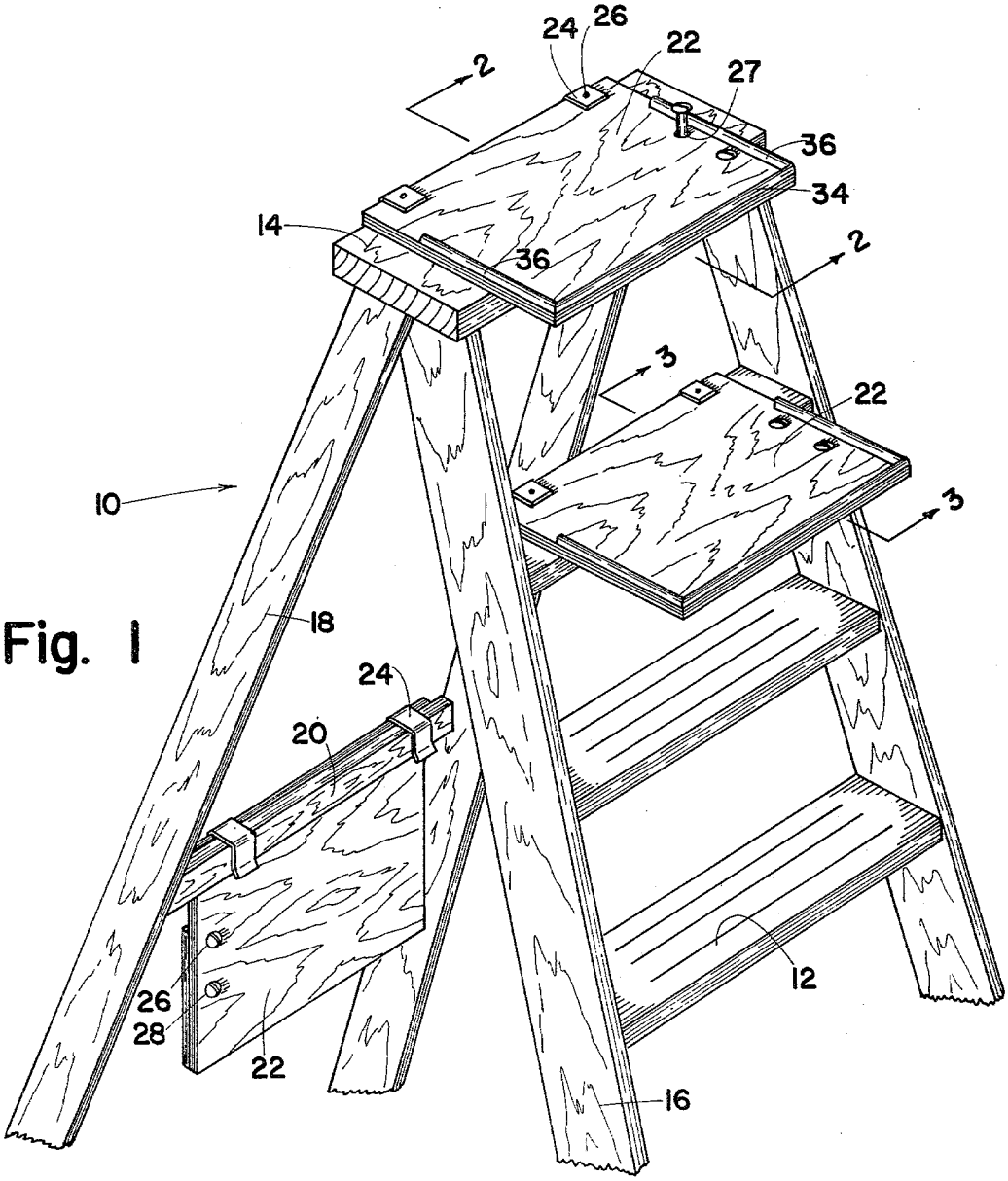
FIG. 1 is a partial view in perspective of a step ladder showing in three positions thereon, a shelf embodying features of this invention.

Referring now to FIG. 1 with greater particularity, there is shown a conventional step ladder 10, with flat steps 12 and a top ledge 14 supported on legs 16 and 18, the back legs 18 being supported by cross braces 20.

The shelf or platform 22 of this invention is of a width to support adequately, a workman's tools and/or equipment, such as a can of paint or plaster (not shown). At the back portion of the shelf 22 are brackets 24, which are secured to the shelf firmly at 26. The brackets 24 have downwardly depending portions **24*a* which engage the back edge 12, 14*a* of the step 12 or top ledge 14 and forwardly extending portions 12*b* which engage the undersurface 12*b*, 14*b* of the step 12 or top ledge 14. The brackets 24 are preferably about equally spaced from the midpoint of the shelf 22** to minimize skewing.

Loosely carried in openings through the shelf 22 are pins 26 and 28 which have enlargements **26*a* and 28*a* at opposite ends to prevent them from sliding completely through the holes 27 in either direction. The pins 26 and 28 are spaced from the depending portion 24*a* of the bracket 24 a distance slightly greater then the width of the step 12 and top ledge 14**, respectively.

Figure 2:
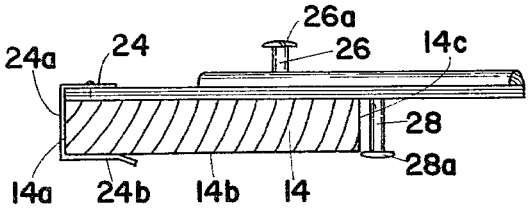
FIG. 2 is a section view taken along line 2—2 of FIG. 1.
Figure 3:
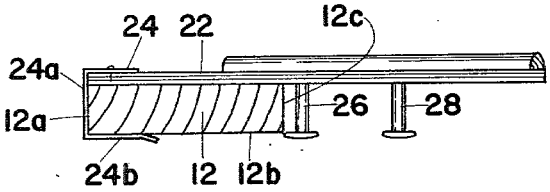
FIG. 3 is a section view taken along line 3—3 of FIG. 1.

When the shelf is placed on a step and pulled forward to the position shown in FIG. 3, both pins 26 and 28 will be unsupported and will fall through to the lower position thereshown. In this position, the pin 28 is idle, but the pin 26, being immediately in front of the leading edge **12*c* of the ladder 12, limits the rearward movement of the shelf 22 so that it can not be inadvertently pushed from the step 12. In similar manner, the brackets 24 may be placed over the front edge of a step or top ledge in which case, the pins 26 and 28** will be engageable with the back edge to prevent inadvertent removal. This is of particular advantage when the worker stands on the ladder, because the overhead overhang is then disposed rearward.

In order to remove the shelf 22, one need merely engage the first pin 26 with one finger and raise it to its elevated position. This provides enough clearance to enable the shelf to be pushed far enough to free the brackets, 24 from the step.

When the shelf 22 is placed on the top edge 14 of the ladder the pin **26*a* will remain elevated, but the pin 28 will drop down in front of the front edge 14*c* so that the shelf can not be inadvertently removed from it. When not in use, the shelf may simply be suspended form the cross brace 20 by engagement of the brackets 24** thereover.

While this invention has been described in conjunction with a preferred embodiment thereof, it is obvious that modification and changes therein may be made by those skilled in the art to which it pertains without departing from the spirit and scope of this invention, as defined by the claims appended hereto.

What I claim as invention is:

1. A work support platform for use with a step ladder comprising:

a flat shelf;

a bracket extending downwardly and then forwardly from one the back edge of said shelf to engage slidably over a ladder step from the back edge thereof;

a first hole through said shelf from top to bottom thereof spaced from said back edge thereof slightly more than the width of a ladder step;

a first pin freely slidable in said first hole so as to drop, when free of restraining surfaces, and depend below the under surface of said shelf and engage the front edge of the ladder step if said shelf is moved toward the back thereof;

a second hole through said shelf spaced from said back edge thereof slightly more then the width of the top ledge of a ladder;

a second pin freely slidable in said second hole so as to drop, when free of restraining surfaces to depend below the undersurface of said shelf and engage the front edge of said top ledge if said shelf is moved toward the back thereof; and enlargements on the ends of said first and second pins to limit movement thereof and to prevent separation thereof from said shelf.

2. The work support platform defined by claim 1 including:

a work-restraining lip on said shelf prtruding above the to surface thereof along the front edge thereof.

3. The work support platform defined by claim 2 including:

work-restraining lip extensions at least partially along the side edges of said shelf.

4. The work support platform defined by claim 1 including:

a second bracket of like configuration on said shelf;

said brackets being spaced approximately equally from the mid-point of said back edge to prevent skewing of said shelf on a ladder step and to facilitate suspension of said shelf from a ladder leg cross brace.

* * * * *